US006237660B1

(12) United States Patent
Giardino

(10) Patent No.: US 6,237,660 B1
(45) Date of Patent: May 29, 2001

(54) PURSE SYSTEM

(76) Inventor: Mavis L. Giardino, 19 Lord St., Elgin, IL (US) 60123

( * ) Notice: Subject to any disclaimer, the term of this patent is extended or adjusted under 35 U.S.C. 154(b) by 0 days.

(21) Appl. No.: 09/435,711

(22) Filed: Nov. 8, 1999

(51) Int. Cl.[7] ..... A45C 13/08

(52) U.S. Cl. ..... 150/105; 150/119; 150/117; 190/110; 190/111; 190/108

(58) Field of Search ..... 150/105, 117, 150/119; 190/110, 111, 108

(56) References Cited

U.S. PATENT DOCUMENTS

| | | | | |
|---|---|---|---|---|
| D. 273,535 | * | 4/1984 | Weinreb | 150/117 X |
| D. 373,515 | * | 9/1996 | Melk | D7/607 |
| D. 403,863 | * | 1/1999 | Briganti | D3/318 |
| 2,355,155 | | 8/1944 | Greenfield . | |
| 2,609,854 | | 9/1952 | Rosen . | |
| 2,650,630 | | 9/1953 | Mytinger . | |
| 2,671,487 | | 3/1954 | Vander Hoek . | |
| 2,694,427 | * | 11/1954 | Hovis | 150/105 |
| 3,202,191 | * | 8/1965 | Kaplan | 150/117 |
| 3,414,033 | | 12/1968 | Tucker . | |
| 3,789,208 | | 1/1974 | Lewis . | |
| 3,963,102 | * | 6/1976 | Carp | 150/105 X |
| 4,068,786 | * | 1/1978 | Taniguchi | 150/119 X |
| 4,112,991 | | 9/1978 | Barbaresi . | |
| 4,754,790 | | 7/1988 | Meyers . | |
| 4,811,769 | | 3/1989 | Phares . | |
| 4,907,633 | | 3/1990 | Eckstein . | |
| 5,207,254 | | 5/1993 | Fromm . | |
| 5,255,833 | * | 10/1993 | McAllister | 150/119 X |
| 5,427,453 | * | 6/1995 | Cloessner | 150/117 X |
| 5,894,975 | | 4/1999 | Holden et al. . | |
| 6,029,723 | * | 2/2000 | Baquero et al. | 150/105 |

* cited by examiner

*Primary Examiner*—Stephen P. Garbe
*Assistant Examiner*—Tri M. Mai
(74) *Attorney, Agent, or Firm*—Joesph N. Breaux

(57) ABSTRACT

A purse system comprising two or more decorative purse bodies each with at least one removable transparent, multiple compartment inner purse lining which is positionable within an interior bottom portion of each of the decorative purse bodies.

1 Claim, 3 Drawing Sheets

PURSE SYSTEM

TECHNICAL FIELD

The present invention relates to devices and methods for purses and more particularly to a purse system including two decorative purse bodies and a multi-compartment, transparent inner purse lining; each of the two decorative purse bodies having an interior purse compartment accessible through a purse flap coverable opening that is sized to receive the multi-compartment, transparent inner purse lining; the transparent multi-compartment, transparent inner purse lining including first, second and third separate, stacked, separately accessible compartments; the first separate, stacked, separately accessible compartment being positioned adjacent to the second, separate, stacked separately accessible compartment and above the second and third, separate, stacked separately accessible compartments; the first, separate, stacked separately accessible compartment having a foldable sealing flap secured by a zipper on three sides for providing a large first compartment access opening into the first, separate, stacked separately accessible compartment; the first and second separate, stacked, separately accessible compartments each having, respectively, first and second inner pockets formed against an internal compartment sidewall thereof that is sized for receiving credit cards, keys and the like.

BACKGROUND ART

There have been numerous purses and handbags developed and designed which provide the user with an extremely useful carrying device. Several of the prior devices disclosed various types of purse systems that include outer shells and inner linings that are removable to allow the contents of the purse to be transferred from one outer shell to another. Despite these prior devices there has never been developed a purse system which solves the problem of matching a purse outer shell with a user's attire while also providing an inner purse system that is easily removed and includes multiple separate compartments easily accessible by a user. Some of the prior patents which disclose and describe handbags are as follows:

Kopel, U.S. Pat. No. 5,649,581 which discloses a purse with a reversible exterior flap. Although Kopel discloses a useful purse device it does not disclose and provide a purse which solves the problem of matching a purse with a user's attire by changing the purses outer shell.

Carey, et al, U.S. Pat. No. 5,533,558 discloses a creative purse with an interchangeable decorative covering. Carey is also a useful purse device however the separable decorative covering does not provide a complete changeable purse shell which alters the purse look to match the user's attire as the present invention. The present invention also allows a user to remove the inner purse system and lay it open on a vanity, bed or other flat surface for easy access the storage compartments of the purse.

Byers, et al, U.S. Pat. No. 5,503,204 discloses a purse with interchangeable closure flaps which can be selectively attached and retained to the purse body. This device is also useful for changing a purse appearance however it does not provide interchangeable purse shell as the present invention which completely alters the purse appearance.

Fromm, U.S. Pat. No. 5,207,254 discloses a handbag assembly with separable inner and outer members which allows for easy conversion of the purse into different styles and configurations. The Fromm purse device differs from the present invention in that the present invention includes a inner purse system which comprises zipper openable construction to allow the inner lining to be unzipped and laid flat on a surface such as a vanity or bed for easy access the compartments of the purse.

Eckstein, U.S. Pat. No. 4,907,633 discloses a handbag assembly to which a variety of outer decorative panels may be selectively attached to the main article carrying bag to suit the desired decor. The Eckstein patent differs from the present invention in that the present invention also includes a convenient inner purse system which comprises a zippered openable construction thereby allowing the inner purse to be unzipped and laid flat on a surface such as a vanity or bed providing the user with easy access to the compartments of the inner purse.

Phares, U.S. Pat. No. 4,811,769 discloses a purse insert capable of retaining a number of articles in separate pockets such that the articles may be transferred from one purse to another by removing and transferring the entire insert. The Phares patent discloses a useful transferring system for purses however it does not provide an inner purse system which may be easily removed to gaining access to all compartment of the purse and also providing changeable decorative purse bodies as the present invention.

Takanashi, U.S. Pat. No. 4,649,947 discloses a handbag having a replaceable decorative cover which includes a face and back sheets with a central core. The device is useful for providing numerous construction materials for constructing the handbag however it does not include an inner purse system as described above and interchangeable decorative purse bodies.

Barbaresi, U.S. Pat. No. 4,112,991 discloses a handbag with a rigid base basket like frame and soft fabric carrier therein. This device is a useful purse with a single exterior shell which differs from the present invention that it does not provide a interchangeable purse body to match the user's taste.

Speaks, U.S. Pat. No. 3,556,187 discloses a lady's handbag with a transparent covering and removable decorative panels inserted between the covering and sides of the handbag. This handbag is also extremely useful in providing a means for altering the appearance of the handbag by inserting a removable decorative panels.

Gilbert, U.S. Pat. No. 3,234,985 discloses a handbag with changeable covers. The Gilbert device is also a useful means of altering handbags however it does not include a means for switching purse outer covers which also includes an inner purse system which may be unzipped and laid flat on a surface such as a vanity or bed for easy access to the compartments of the purse.

Rosen, U.S. Pat. No. 2,609,854 discloses an interchangeable lining for a pocket book. This invention is a useful pocketbook device however it does not include an interchangeable purse body as the present invention along with an inner purse system which may be laid flat for easy access to the numerous compartments within the purse.

GENERAL SUMMARY DISCUSSION OF INVENTION

It is thus an object of the invention to provide a purse system that includes two decorative purse bodies and a multi-compartment, transparent inner purse lining; each of the two decorative purse bodies having an interior purse compartment accessible through a purse flap coverable opening that is sized to receive the multi-compartment, transparent inner purse lining; the transparent multi-compartment, transparent inner purse lining including first, second and third separate, stacked, separately accessible compartments; the first separate, stacked, separately accessible compartment being positioned adjacent to the second, separate, stacked separately accessible compartment and above the second and third, separate, stacked separately accessible compartments; the first, separate, stacked separately accessible compartment having a foldable sealing flap secured by a zipper on three sides for providing a large first compartment access opening into the first, separate, stacked separately accessible compartment; the first and second separate, stacked, separately accessible compartments each having, respectively, first and second inner pockets formed against an internal compartment sidewall thereof that is sized for receiving credit cards, keys and the like.

Accordingly, a purse system is provided. The purse system includes two decorative purse bodies and a multi-compartment, transparent inner purse lining; each of the two decorative purse bodies having an interior purse compartment accessible through a purse flap coverable opening that is sized to receive the multi-compartment, transparent inner purse lining; the transparent multi-compartment, transparent inner purse lining including first, second and third separate, stacked, separately accessible compartments; the first separate, stacked, separately accessible compartment being positioned adjacent to the second, separate, stacked separately accessible compartment and above the second and third, separate, stacked separately accessible compartments; the first, separate, stacked separately accessible compartment having a foldable sealing flap secured by a zipper on three sides for it providing a large first compartment access opening into the first, separate, stacked separately accessible compartment; the first and second separate, stacked, separately accessible compartments each having, respectively, first and second inner pockets formed against an internal compartment sidewall thereof that is sized for receiving credit cards, keys and the like.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
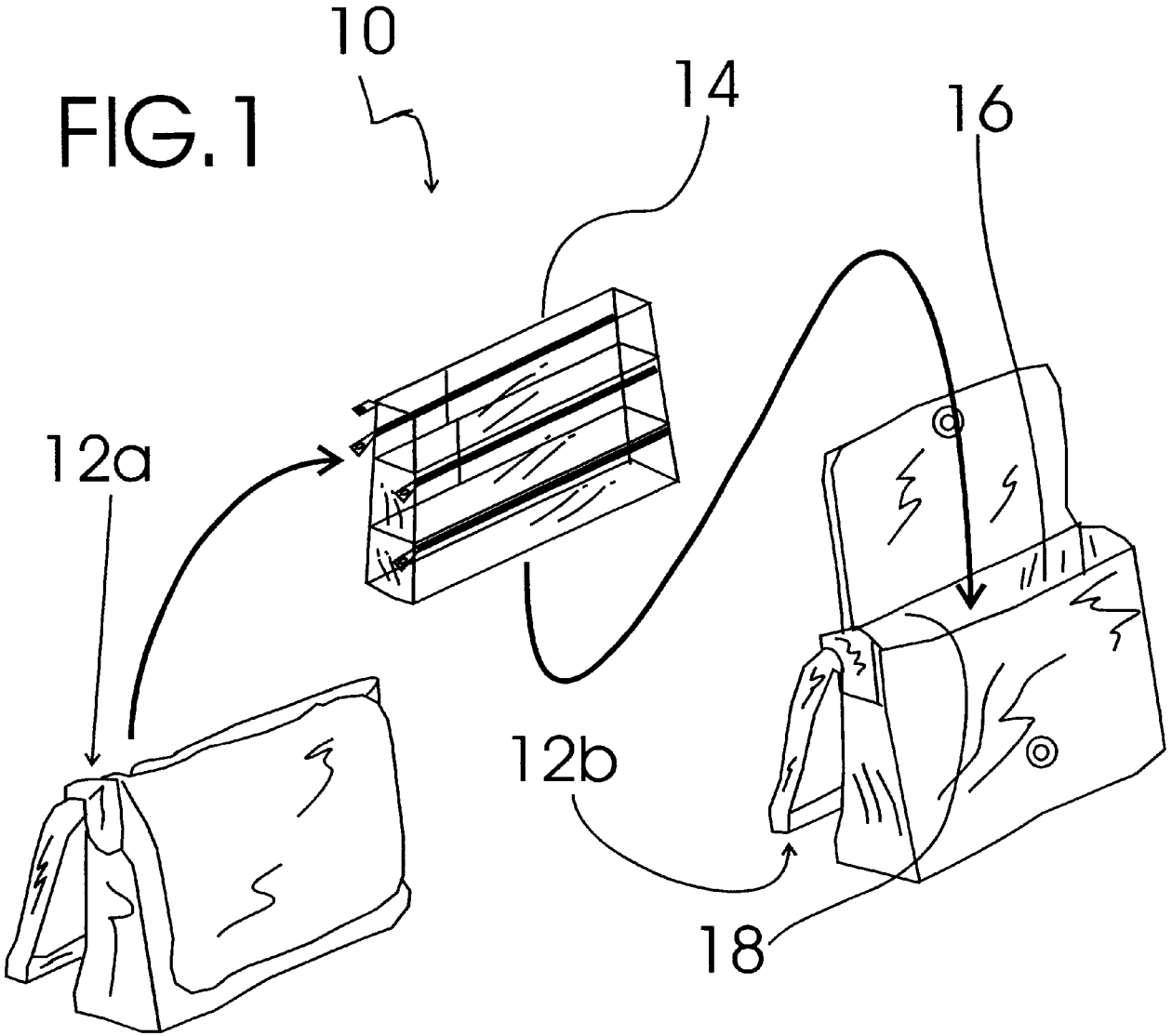
FIG. 1 is a perspective view of an exemplary embodiment of the purse system of the present invention showing two decorative purse bodies and the multi-compartment, transparent inner purse lining; each of the two decorative purse bodies having an interior purse compartment accessible through a purse flap coverable opening that is sized to receive the multi-compartment, transparent inner purse lining.

FIG. 1 is a perspective view of an exemplary embodiment of the purse system of the present invention generally designated 10. Purse system 10, includes two decorative purse bodies, generally designated 12*a*,12*b*, and a multi-compartment, transparent inner purse lining, generally designated 14. Each of the two decorative purse bodies 12*a*,12*b* has an interior purse compartment 16 that is accessible through a purse flap coverable opening 18. Interior purse compartment 16 is sized to receive multi-compartment, transparent inner purse lining 14.

Figure 2:
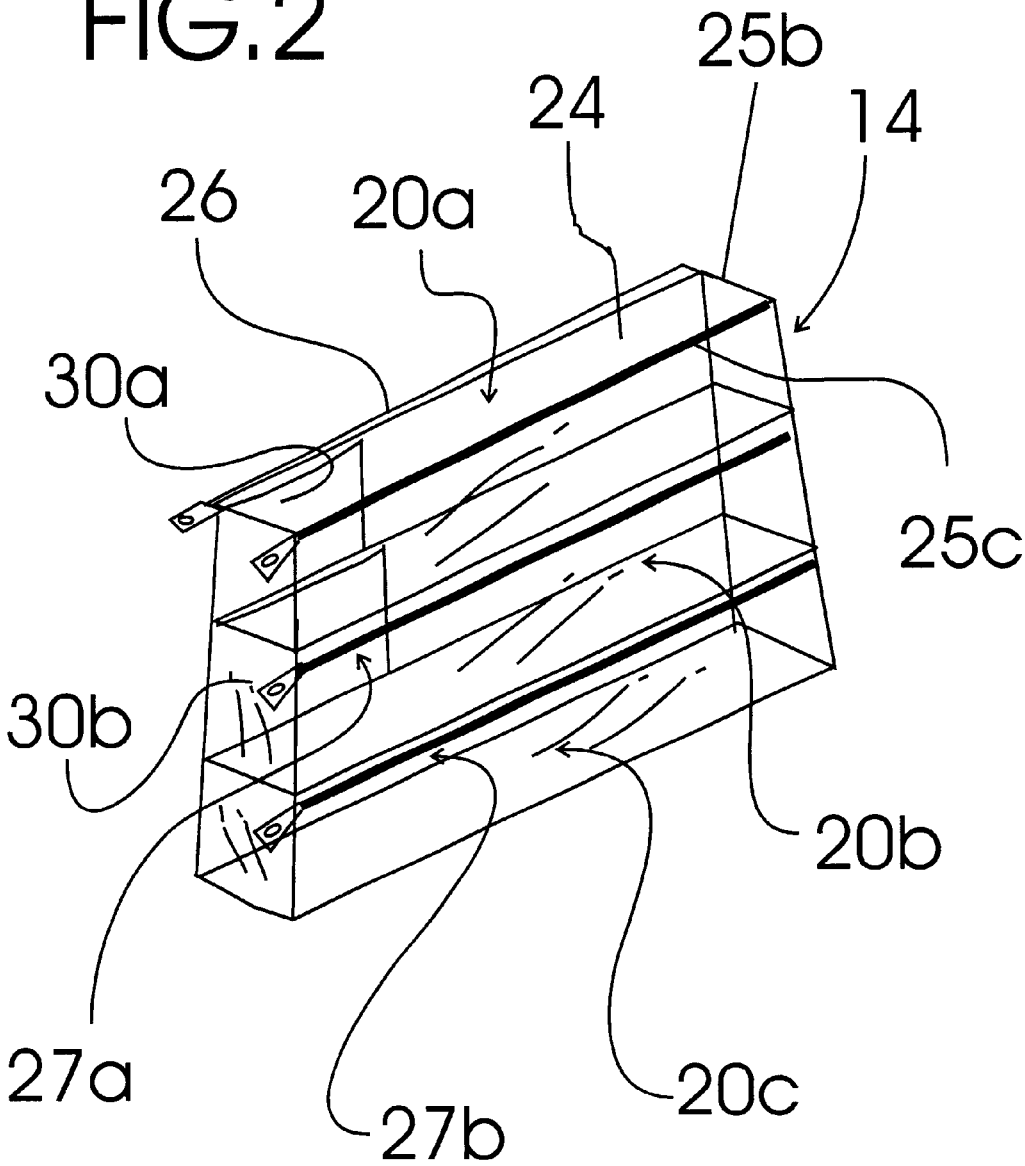
FIG. 2 is an isometric view of the exemplary multi-compartment, transparent inner purse lining showing first, second and third separate, stacked, separately accessible compartments; the first compartment being positioned adjacent to the second, separate, stacked separately accessible compartment and above the second and third, separate, stacked separately accessible compartments; the first, separate, stacked separately accessible compartment having a foldable sealing flap secured by a zipper on three sides for providing a large first compartment access opening into the first, separate, stacked separately accessible compartment.
Figures 2A, 2B, 2C:
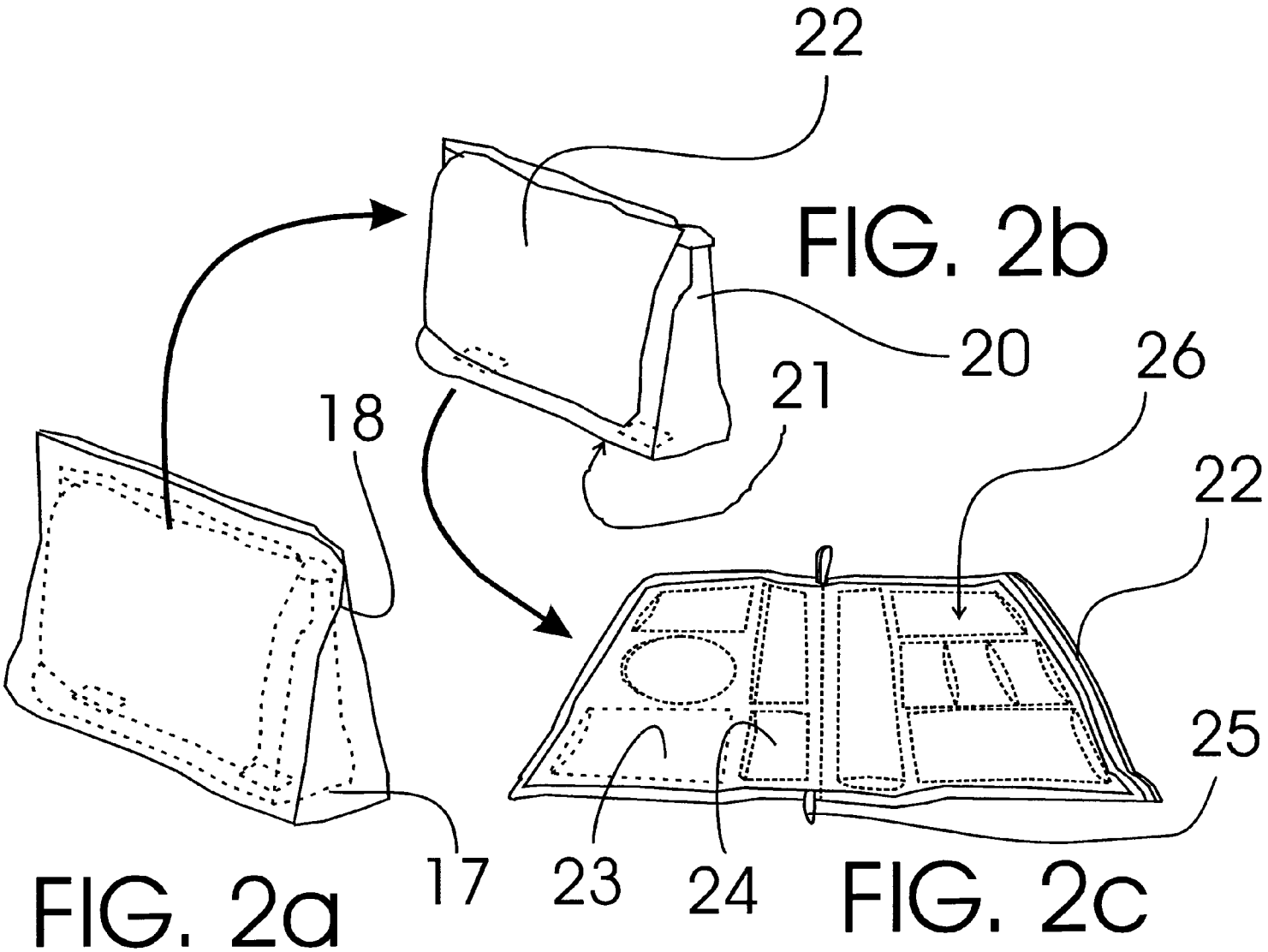

Referring to FIG. 2, multi-compartment, transparent inner purse lining includes first, second and third separate, stacked, separately accessible compartments, respectively generally 20*a*,20*b*,20*c*. First compartment 20*a* is positioned adjacent to second, separate, stacked separately accessible compartment 20*b* and above second and third, separate, stacked separately accessible compartments 20*b*,20*c*. First separate, stacked separately accessible compartment 20 has a foldable sealing flap 24 secured by a zipper 26 on three sides 25*a–c* for providing a large first compartment access opening into first, separate, stacked separately accessible compartment 20*a*. Second and third sealable, stacked, separately accessible compartments 20*b*,20*c* are each accessible through a respective zipper closure 27*a*,27*b*. First and second separate, stacked, separately accessible compartments 20*a*,20*b* each have, respectively, a first or a second inner pocket 30*a*,30*b* formed against an internal compartment sidewall thereof.

It can be seen that a purse system has been provided that includes two decorative purse bodies and a multi-compartment, transparent inner purse lining; each of the two decorative purse bodies having an interior purse compartment accessible through a purse flap covetable opening that is sized to receive the multi-compartment, transparent inner purse lining; the transparent multi-compartment, transparent inner purse lining including first, second and third separate, stacked, separately accessible compartments; the first separate, stacked, separately accessible compartment being positioned adjacent to the second, separate, stacked separately accessible compartment and above the second and third, separate, stacked separately accessible compartments; the first, separate, stacked separately accessible compartment having a foldable sealing flap secured by a zipper on three sides for providing a large first compartment access opening into the first, separate, stacked separately accessible compartment; the first and second separate, stacked, separately accessible compartments each having, respectively, first and second inner pockets formed against an internal compartment sidewall thereof that is sized for receiving credit cards, keys and the like.

It is noted that the embodiment of the purse system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A purse system comprising:

two decorative purse bodies; and a multi-compartment, transparent inner purse lining;

each of said two decorative purse bodies having an interior purse compartment accessible through a purse flap covetable opening that is sized to receive said multi-compartment, transparent inner purse lining;

said transparent multi-compartment, transparent inner purse lining including first, second and third separate, stacked, separately accessible compartments;

said first separate, stacked, separately accessible compartment being positioned adjacent to said second, separate, stacked separately accessible compartment and above said second and third, separate, stacked separately accessible compartments;

said first, separate, stacked separately accessible compartment having a foldable sealing flap secured by a zipper on three sides for providing a large first compartment access opening into said first, separate, stacked separately accessible compartment;

said first and second separate, stacked, separately accessible compartments each having, respectively, first and second inner pockets formed against an internal compartment sidewall thereof.

* * * * *